US011444364B2

(12) United States Patent
Shi

(10) Patent No.: US 11,444,364 B2
(45) Date of Patent: Sep. 13, 2022

(54) FOLDED WAVEGUIDE FOR ANTENNA

(71) Applicant: Aptiv Technologies Limited, St. Michael (BB)

(72) Inventor: Shawn Shi, Thousand Oaks, CA (US)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 17/131,534

(22) Filed: Dec. 22, 2020

(65) Prior Publication Data

US 2022/0200121 A1 Jun. 23, 2022

(51) Int. Cl.

| | |
|---|---|
| ***H01Q 13/22*** | (2006.01) |
| ***H01P 3/12*** | (2006.01) |
| ***H01P 3/123*** | (2006.01) |
| ***H01Q 1/32*** | (2006.01) |

(52) U.S. Cl.

CPC ..... *H01P 3/123* (2013.01); *H01Q 1/3233* (2013.01); *H01Q 13/22* (2013.01)

(58) Field of Classification Search

CPC ..... H01Q 1/3233; H01Q 13/10; H01Q 13/12; H01Q 13/16; H01Q 13/18; H01Q 13/22; H01Q 21/00; H01Q 21/005; H01P 3/12; H01P 3/123; H01P 5/10; H01P 5/107

See application file for complete search history.

(56) References Cited

U.S. PATENT DOCUMENTS

| | | | |
|---|---|---|---|
| 3,029,432 | A | 4/1962 | Hansen |
| 3,462,713 | A | 8/1969 | Knerr |
| 3,473,162 | A | 10/1969 | Veith |
| 3,579,149 | A | 5/1971 | Ramsey |
| 4,157,516 | A | 6/1979 | Van De Grijp |

(Continued)

FOREIGN PATENT DOCUMENTS

| | | |
|---|---|---|
| CA | 2654470 | 12/2007 |
| CN | 1620738 | 5/2005 |

(Continued)

OTHER PUBLICATIONS

"Extended European Search Report", EP Application No. 18153137.7, dated Jun. 15, 2018, 8 pages.

(Continued)

*Primary Examiner* — Tho G Phan

(74) *Attorney, Agent, or Firm* — Sawtooth Patent Group PLLC

(57) ABSTRACT

This document describes a folded waveguide for antenna. The folded waveguide may be an air waveguide and includes a hollow core that forms a rectangular opening in a longitudinal direction at one end, a closed wall at an opposite end, and a sinusoidal shape that folds back and forth about a longitudinal axis that runs in the longitudinal direction through the hollow core. The hollow core forms a plurality of radiation slots, each including a hole through one of multiple surfaces that defines the hollow core. The radiation slots are arranged on the one surface to produce a particular antenna pattern. The radiation slots and sinusoidal shape enable the folded waveguide to prevent grating lobes from appearing in the particular antenna pattern on either side of a horizontal-polarity, main beam, or to prevent X-band lobes from appearing in the particular antenna pattern on either side of a vertical-polarity, main beam.

20 Claims, 11 Drawing Sheets

(56) References Cited

U.S. PATENT DOCUMENTS

| | | | | |
|---|---|---|---|---|
| 4,453,142 | A | 6/1984 | Murphy | |
| 4,562,416 | A | 12/1985 | Sedivec | |
| 4,839,663 | A * | 6/1989 | Kurtz | H01Q 21/245 343/770 |
| 5,337,065 | A * | 8/1994 | Bonnet | H01Q 21/0081 343/770 |
| 5,541,612 | A * | 7/1996 | Josefsson | H01Q 25/001 333/237 |
| 5,982,256 | A | 11/1999 | Uchimura et al. | |
| 5,986,527 | A | 11/1999 | Ishikawa et al. | |
| 6,489,855 | B1 | 12/2002 | Kitamori et al. | |
| 6,794,950 | B2 | 9/2004 | Du Tolt et al. | |
| 6,867,660 | B2 | 3/2005 | Kitamori et al. | |
| 6,958,662 | B1 | 10/2005 | Salmela et al. | |
| 7,973,616 | B2 | 7/2011 | Shijo et al. | |
| 7,994,879 | B2 | 8/2011 | Kim et al. | |
| 8,013,694 | B2 | 9/2011 | Hiramatsu et al. | |
| 8,089,327 | B2 | 1/2012 | Margomenos et al. | |
| 8,159,316 | B2 | 4/2012 | Miyazato et al. | |
| 8,692,731 | B2 | 4/2014 | Lee et al. | |
| 9,007,269 | B2 | 4/2015 | Lee et al. | |
| 9,368,878 | B2 * | 6/2016 | Chen | H01Q 21/0043 |
| 9,450,281 | B2 | 9/2016 | Kim | |
| 9,537,212 | B2 * | 1/2017 | Rosen | H01Q 21/08 |
| 9,673,532 | B2 | 6/2017 | Cheng et al. | |
| 9,935,065 | B1 | 4/2018 | Baheti et al. | |
| 10,468,736 | B2 | 11/2019 | Mangaiahgari | |
| 10,775,573 | B1 | 9/2020 | Hsu et al. | |
| 10,833,385 | B2 | 11/2020 | Mangaiahgari et al. | |
| 11,171,399 | B2 * | 11/2021 | Alexanian | G01S 3/40 |
| 2002/0021197 | A1 | 2/2002 | Elco | |
| 2004/0069984 | A1 | 4/2004 | Estes et al. | |
| 2004/0174315 | A1 | 9/2004 | Miyata | |
| 2006/0113598 | A1 | 6/2006 | Chen et al. | |
| 2008/0129409 | A1 | 6/2008 | Nagaishi et al. | |
| 2008/0150821 | A1 | 6/2008 | Koch et al. | |
| 2009/0207090 | A1 | 8/2009 | Pettus et al. | |
| 2009/0243762 | A1 | 10/2009 | Chen et al. | |
| 2012/0013421 | A1 | 1/2012 | Hayata | |
| 2012/0050125 | A1 | 3/2012 | Leiba et al. | |
| 2012/0068316 | A1 | 3/2012 | Ligander | |
| 2012/0163811 | A1 | 6/2012 | Doany et al. | |
| 2012/0242421 | A1 | 9/2012 | Robin et al. | |
| 2012/0256796 | A1 | 10/2012 | Leiba | |
| 2013/0057358 | A1 | 3/2013 | Anthony et al. | |
| 2014/0015709 | A1 | 1/2014 | Shijo et al. | |
| 2014/0091884 | A1 | 4/2014 | Flatters | |
| 2014/0106684 | A1 | 4/2014 | Burns et al. | |
| 2015/0097633 | A1 | 4/2015 | Devries et al. | |
| 2015/0229017 | A1 | 8/2015 | Suzuki et al. | |
| 2015/0357698 | A1 | 12/2015 | Kushta | |
| 2015/0364804 | A1 | 12/2015 | Tong et al. | |
| 2015/0364830 | A1 | 12/2015 | Tong et al. | |
| 2016/0043455 | A1 | 2/2016 | Seler et al. | |
| 2016/0049714 | A1 | 2/2016 | Ligander et al. | |
| 2016/0118705 | A1 | 4/2016 | Tang et al. | |
| 2016/0204495 | A1 | 7/2016 | Takeda et al. | |
| 2016/0276727 | A1 | 9/2016 | Dang et al. | |
| 2016/0293557 | A1 | 10/2016 | Topak et al. | |
| 2016/0301125 | A1 | 10/2016 | Kim et al. | |
| 2017/0084554 | A1 | 3/2017 | Dogiamis et al. | |
| 2017/0324135 | A1 | 11/2017 | Blech et al. | |
| 2018/0131084 | A1 | 5/2018 | Park et al. | |
| 2018/0226709 | A1 | 8/2018 | Mangaiahgari | |
| 2018/0233465 | A1 | 8/2018 | Spella et al. | |
| 2018/0284186 | A1 | 10/2018 | Chadha et al. | |
| 2018/0343711 | A1 | 11/2018 | Wixforth et al. | |
| 2018/0351261 | A1 | 12/2018 | Kamo et al. | |
| 2019/0006743 | A1 | 1/2019 | Kirino et al. | |
| 2019/0013563 | A1 | 1/2019 | Takeda et al. | |
| 2019/0324134 | A1 | 10/2019 | Cattle | |
| 2020/0021001 | A1 | 1/2020 | Mangaiahgairi | |
| 2020/0059002 | A1 * | 2/2020 | Renard | H01Q 21/0087 |
| 2020/0235453 | A1 | 7/2020 | Lang | |
| 2020/0343612 | A1 | 10/2020 | Shi | |
| 2021/0036393 | A1 | 2/2021 | Mangaiahgari | |

FOREIGN PATENT DOCUMENTS

| | | | |
|---|---|---|---|
| CN | 2796131 | | 7/2006 |
| CN | 201383535 | | 1/2010 |
| CN | 103515682 | | 1/2014 |
| CN | 104900956 | | 9/2015 |
| CN | 105609909 | | 5/2016 |
| CN | 105680133 | | 6/2016 |
| CN | 105958167 | | 9/2016 |
| CN | 108258392 | A | 7/2018 |
| CN | 209389219 | | 9/2019 |
| DE | 102019200893 | | 7/2020 |
| EP | 0818058 | A1 | 1/1998 |
| EP | 2500978 | | 9/2012 |
| EP | 2843758 | | 3/2015 |
| EP | 3460903 | | 3/2019 |
| GB | 893008 | A | 4/1962 |
| GB | 2489950 | | 10/2012 |
| JP | 2003289201 | | 10/2003 |
| KR | 100846872 | | 5/2008 |
| WO | 2013189513 | | 12/2013 |
| WO | 2018003932 | | 1/2018 |

OTHER PUBLICATIONS

"Extended European Search Report", EP Application No. 20166797, dated Sep. 16, 2020, 11 pages.
"Non-Final Office Action", U.S. Appl. No. 16/583,867, dated Feb. 18, 2020, 8 pages.
"Non-Final Office Action", U.S. Appl. No. 15/427,769, dated Nov. 13, 2018, 8 pages.
"Notice of Allowance", U.S. Appl. No. 15/427,769, dated Jun. 28, 2019, 9 pages.
"Notice of Allowance", U.S. Appl. No. 16/583,867, dated Jul. 8, 2020, 8 Pages.
Jankovic, et al., "Stepped Bend Substrate Integrated Waveguide to Rectangular Waveguide Transitions", Jun. 2016, 2 pages.
"Foreign Office Action", CN Application No. 201810122408.4, dated Oct. 18, 2021, 19 pages.
"Non-Final Office Action", U.S. Appl. No. 16/829,409, dated Oct. 14, 2021, 13 pages.
"Non-Final Office Action", U.S. Appl. No. 17/061,675, dated Dec. 20, 2021, 4 pages.
Wang, et al., "Mechanical and Dielectric Strength of Laminated Epoxy Dielectric Graded Materials", Mar. 2020, 15 pages.
"Foreign Office Action", CN Application No. 201810122408.4, dated Jun. 2, 2021, 15 pages.
"Extended European Search Report", EP Application No. 21211474.8, dated Apr. 20, 2022, 14 pages.
Wang, et al., "Low-loss frequency scanning planar array with hybrid feeding structure for low-altitude detection radar", Sep. 13, 2019, pp. 6708-6711.

* cited by examiner

FOLDED WAVEGUIDE FOR ANTENNA

BACKGROUND

Some devices (e.g., radar) use electromagnetic signals to detect and track objects. The electromagnetic signals are transmitted and received using one or more antennas. An antenna may be characterized in terms of gain, beam width, or, more specifically, in terms of the antenna pattern, which is a measure of the antenna gain as a function of direction. Certain applications may benefit from precisely controlling the antenna pattern. A waveguide may be used to improve these antenna characteristics. The waveguide can include perforations that improve an antenna pattern by leaking some of the electromagnetic radiation that is directed towards the antenna. However, these waveguides cannot prevent grating lobes on either side of a horizontal-polarity main beam, nor can they prevent X-band lobes on either side of a vertical-polarity main beam.

SUMMARY

This document describes techniques, apparatuses, and systems utilizing a folded waveguide for antenna. The folded waveguide may be an air waveguide and is referred to throughout this document as simply a waveguide for short. The described waveguide includes a hollow core. The hollow core forms a rectangular opening in a longitudinal direction at one end, a closed wall at an opposite end, and a sinusoidal shape that folds back and forth about a longitudinal axis that runs in the longitudinal direction through the hollow core. The hollow core further forms a plurality of radiation slots, each of the radiation slots including a hole through one of multiple surfaces of the folded waveguide that defines the hollow core. The plurality of radiation slots is arranged on the one of the multiple surfaces to produce a particular antenna pattern at an antenna element when the antenna element is electrically coupled to the opposite end of the hollow core.

This Summary introduces simplified concepts related to a folded waveguide antenna, which are further described below in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of techniques, apparatuses, and systems utilizing a folded waveguide for antenna are described in this document with reference to the following figures. The same numbers are often used throughout the drawings to reference like features and components:

FIG. 2-1 illustrates an example folded waveguide for antenna, in accordance with techniques, apparatuses, and systems of this disclosure;

FIG. 2-2 illustrates an antenna pattern associated with the example folded waveguide for antenna shown in FIG. 2-1;

FIG. 2-3 illustrates an antenna pattern without the example folded waveguide for antenna shown in FIG. 2-1;

FIG. 3-1 illustrates another example folded waveguide for antenna, in accordance with techniques, apparatuses, and systems of this disclosure;

FIG. 3-2 illustrates an antenna pattern associated with the example folded waveguide for antenna shown in FIG. 3-1;

FIG. 3-3 illustrates an antenna pattern without the example folded waveguide for antenna shown in FIG. 3-1;

FIG. 4-1 illustrates another example folded waveguide for antenna, in accordance with techniques, apparatuses, and systems of this disclosure;

FIG. 4-2 illustrates an antenna pattern associated with the example folded waveguide for antenna shown in FIG. 4-1.

DETAILED DESCRIPTION

Overview

Radar systems are an important sensing technology used in many industries, including the automotive industry, to acquire information about the surrounding environment. An antenna is used in radar systems to transmit and receive electromagnetic (EM) energy or signals. Some radar systems use multiple antenna elements in an array to provide increased gain and directivity over what can be achieved using a single antenna element. In reception, signals from the individual elements are combined with appropriate phases and weighted amplitudes to provide the desired antenna reception pattern. Antenna arrays are also used in transmission, splitting signal power amongst the elements, using appropriate phases and weighted amplitudes to provide the desired antenna transmission pattern. A waveguide can be used to transfer EM energy to and from the antenna elements. Further, waveguides can be arranged to provide the desired phasing, combining, or splitting of signals and energy.

In contrast, this document describes techniques, apparatuses, and systems utilizing a folded waveguide for antenna. The folded waveguide may be an air waveguide and includes a hollow core that forms a rectangular opening in a longitudinal direction at one end, a closed wall at an opposite end, and a sinusoidal shape that folds back and forth about a longitudinal axis that runs in the longitudinal direction through the hollow core. The hollow core forms a plurality of radiation slots, each including a hole through one of multiple surfaces that defines the hollow core. The radiation slots are arranged on the one surface to produce a particular antenna pattern. The radiation slots and sinusoidal shape enable the folded waveguide to prevent grating lobes from appearing in the particular antenna pattern on either side of a horizontal-polarity main beam, or to prevent X-band lobes from appearing in the particular antenna pattern on either side of a vertical-polarity main beam.

This is just one example of the described techniques, apparatuses, and systems of a folded waveguide for antenna. This document describes other examples and implementations.

Example System

Figure 1:
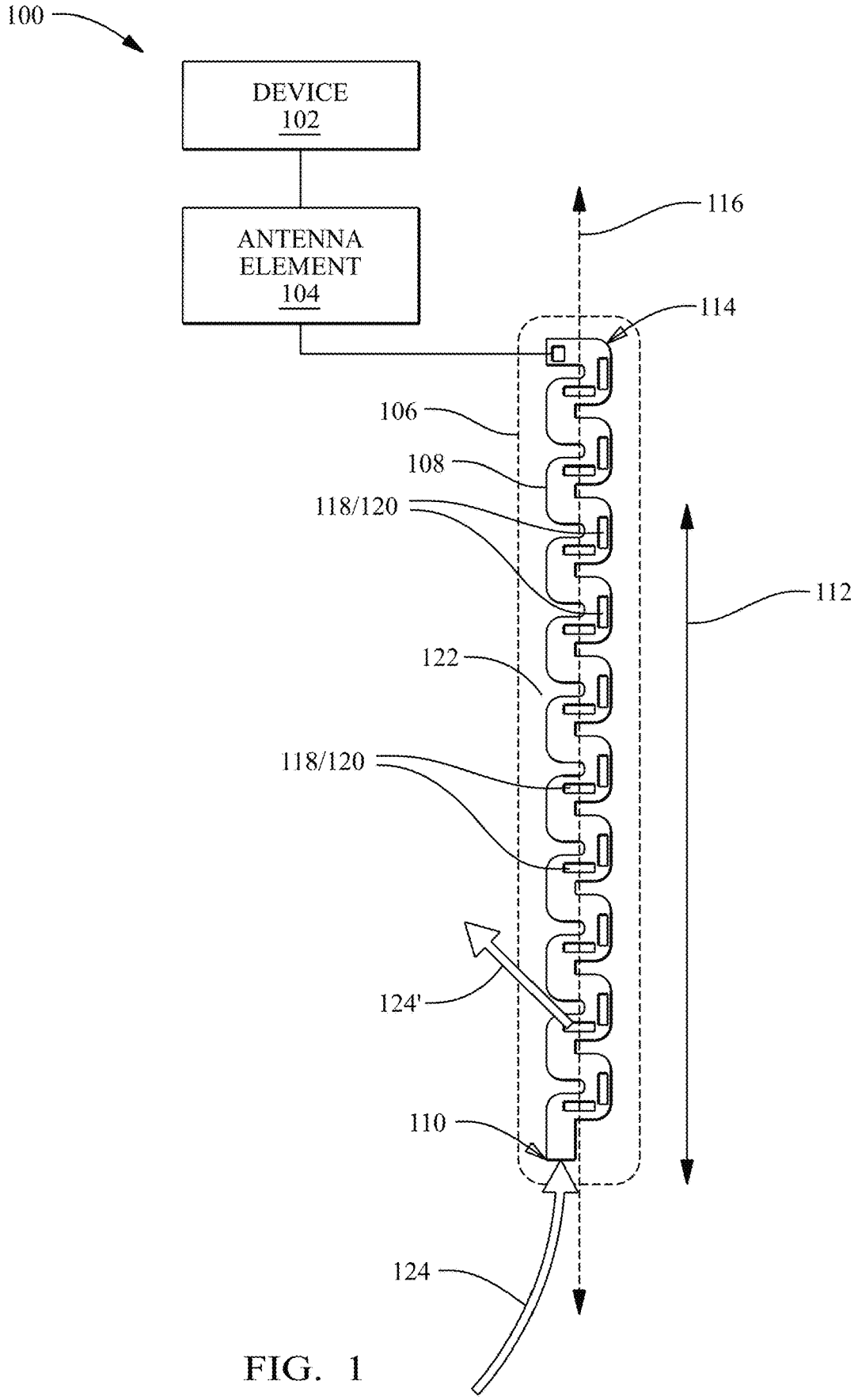
FIG. 1 illustrates an example system that includes a folded waveguide for antenna, in accordance with techniques, apparatuses, and systems of this disclosure.

FIG. 1 illustrates an example system 100 that includes a folded waveguide for antenna, in accordance with techniques, apparatuses, and systems of this disclosure. The system includes a device 102, an antenna 104, and a waveguide 106. The system 100 may be part of a vehicle, such as a self-driving automobile. Portions of the system 100 may be integrated onto a printed circuit board or substrate.

The device 102 is configured to receive and process signals to perform a function. The device 102 may be a radar device, an ultrasound device, or other device configured to receive electromagnetic signals. An input to the device 102 is operatively coupled to the antenna 104.

The antenna 104 is configured to capture electromagnetic signals 124 and channel them to the device 102. The antenna 104 and the device 102 may be coupled via wired or wireless links. These links carry electromagnetic signals 124 from the antenna 104 to the device 102.

The waveguide 106 is a folded waveguide and configured to channel electromagnetic signals 124 being transmitted through air to the antenna 104 and the device 102. The waveguide 106 includes a hollow core 108. The folded waveguide 106 may include metal. The folded waveguide 106 may include plastic. A combination of plastic and metal may be used to form the waveguide 106. In FIG. 1, the waveguide 106 is viewed from above. A top surface 122 is visible, which is one of multiple surfaces of the waveguide 106 that forms the hollow core 108.

The hollow core 108 forms a rectangular opening 110 in a longitudinal direction 112 at one end and a closed wall 114 at an opposite end. This opposite end with the closed wall 114 is operatively coupled to the antenna 104. Electromagnetic signals enter the waveguide 106 through the opening 110, and some signals exit the waveguide 106 at the opposite end and to the antenna 104. The hollow core 108 forms a sinusoidal shape that folds back and forth about a longitudinal axis 116 that runs in the longitudinal direction 112 through the hollow core 108.

The hollow core 108 also forms a plurality of radiation slots 118. Each of the radiation slots 118 includes a respective hole 120 through one surface 122 of the multiple surfaces of the folded waveguide 106 that defines the hollow core 108. For example, the top surface 122 of the waveguide 106 may include radiation slots 118 similar to those shown in FIG. 1. The plurality of radiation slots 118 are arranged on the surface 122 to produce a particular antenna pattern for the device 102 and the antenna 104 that is electrically coupled to the opposite end of the hollow core 108.

As shown in FIG. 1, the plurality of radiation slots 118 are configured to dissipate, from the hollow core 108, a portion 124' of electromagnetic-radiation 124 that enters the rectangular opening 110 before that portion 124' of the electromagnetic radiation 124 can reach the antenna 104 that is electrically coupled to the opposite end of the hollow core 108. In other words, the electromagnetic radiation is allowed to leak out the radiation slots 118 on its way through the hollow core 108 in the longitudinal direction 112. Each of the plurality of radiation slots 118 is sized and positioned on one of the multiple surfaces to produce the particular antenna pattern at the antenna 104 that is electrically coupled to the opposite end of the hollow core 108.

Example Apparatus

Figure 2:
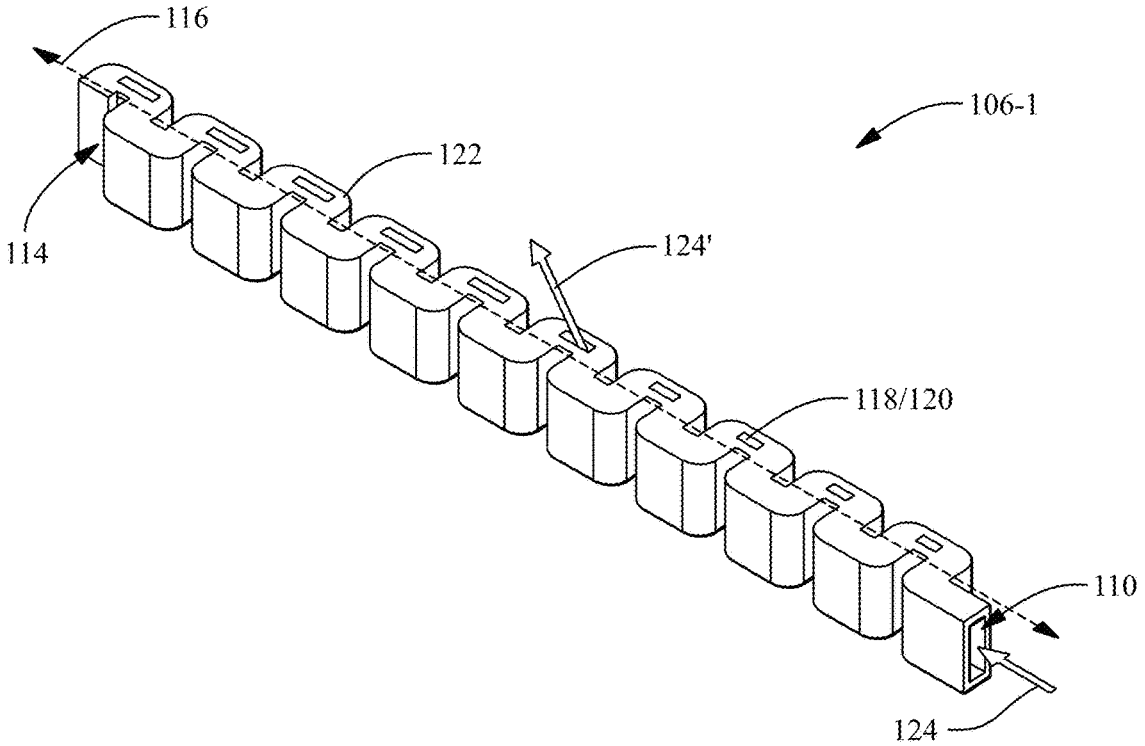
Figure 1:
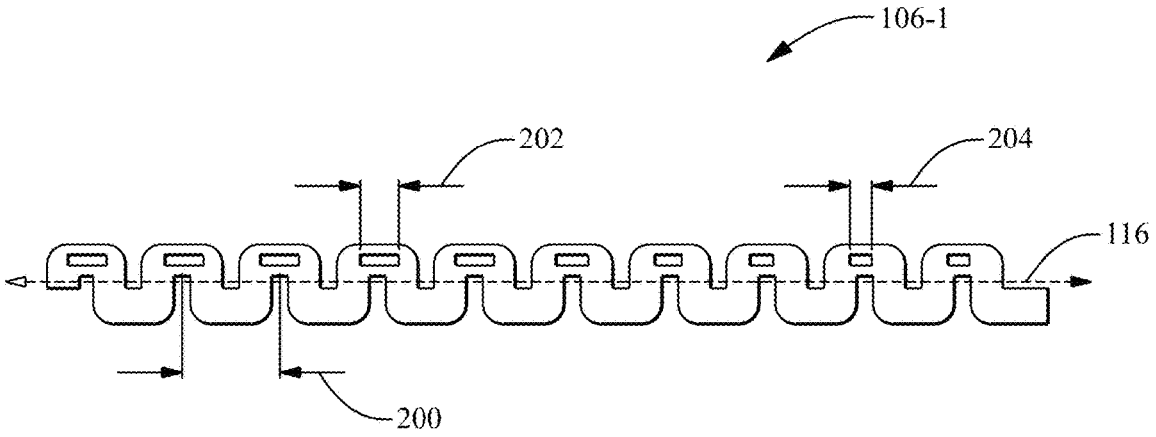
Figure 2:
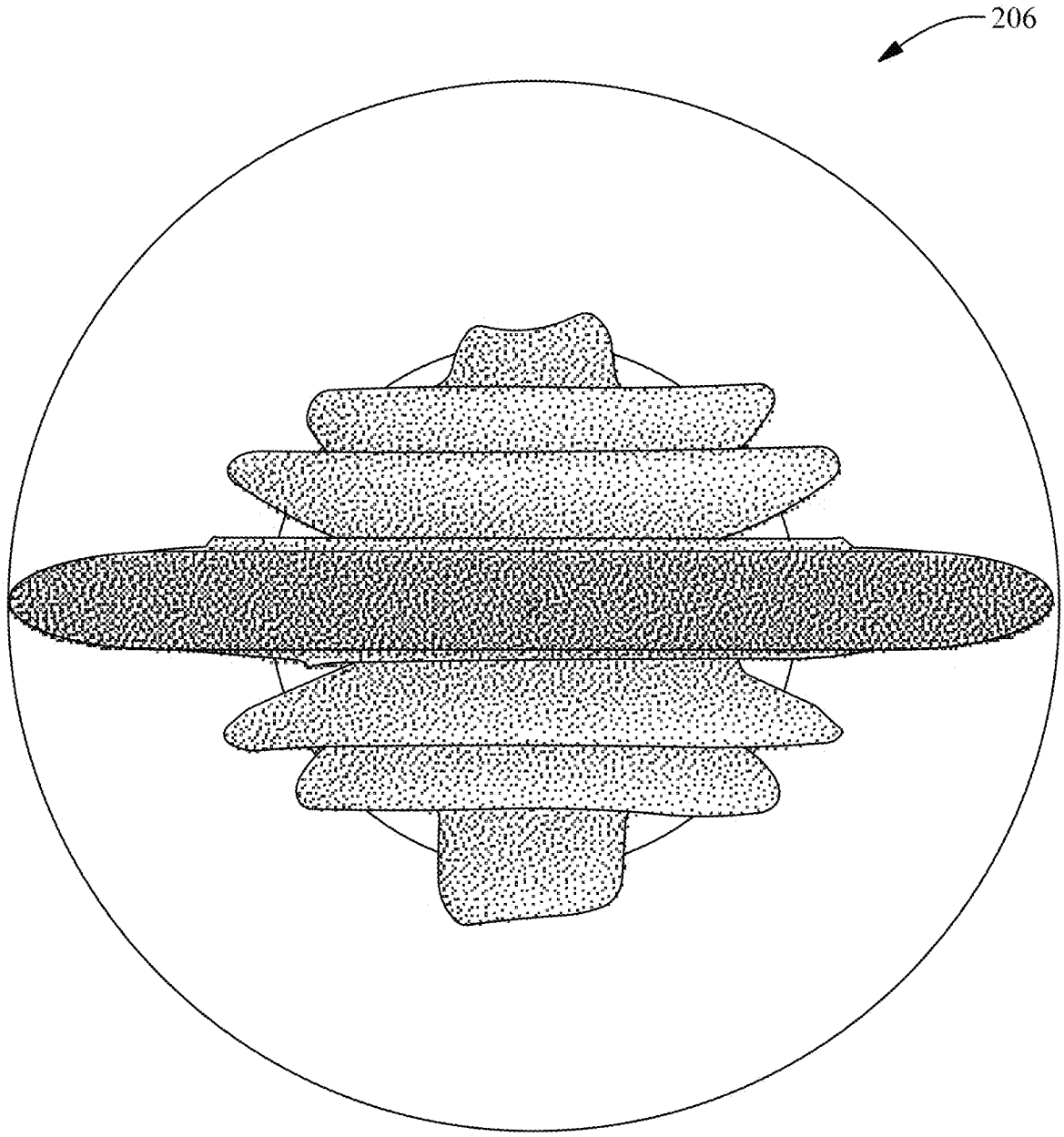

FIG. 2-1 illustrates an example folded waveguide 106-1 for antenna, in accordance with techniques, apparatuses, and systems of this disclosure. The waveguide 106-1 is an example of the waveguide 106. Each radiation slot from the plurality of radiation slots 118 includes a longitudinal slot that is parallel to the longitudinal axis 116 to produce a horizontal-polarized antenna pattern at the antenna element that is electrically coupled to the opposite end of the hollow core.

As shown in FIG. 2-1, the plurality of radiation slots 118 are evenly distributed between the rectangular opening 110 and the closed wall 114, and along the longitudinal axis 116 that runs in the longitudinal direction 112 through the hollow core 108. Each adjacent pair of radiation slots from the plurality of radiation slots 118 includes two radiation slots that are separated along the longitudinal axis 116 by a common distance 200 to produce the particular antenna pattern at the antenna 104 that is electrically coupled to the opposite end of the hollow core 108. The separation by the common distance 200 can prevent grating lobes. The common distance 200 is less than one wavelength of the electromagnetic radiation 124 that reaches the opposite end of the hollow core 108.

Each of the plurality of radiation slots 118 is sized and positioned on the surface 122 to produce a particular antenna pattern. The holes 120 of the plurality of radiation slots 118 have a larger size 202 near the wall 114 at the opposite end of the hollow core 108 and a smaller size 204 near the rectangular opening 110. The specific size and position of the radiation slots 118 can be determined by building and optimizing a model of the waveguide 106 to produce the particular desired antenna pattern. The radiation slots 118 are fed in-phase, hence the reason to be the common distance 200 apart.

FIG. 2-2 illustrates an antenna pattern associated with the example folded waveguide for antenna shown in FIG. 2-1. Because each radiation slot is a longitudinal slot that is parallel to the longitudinal axis 116, the waveguide 106 is tuned to produce a horizontal-polarized antenna pattern 206 at the antenna 104. As shown in FIG. 2-2, the grating lobes can be avoided if the pitch of common distance 200 is less than the electromagnetic-radiation 124 wavelength. Elevation of the side lobe can be controlled by changing the size or length of the radiation slots 118.

Figures 2, 3:
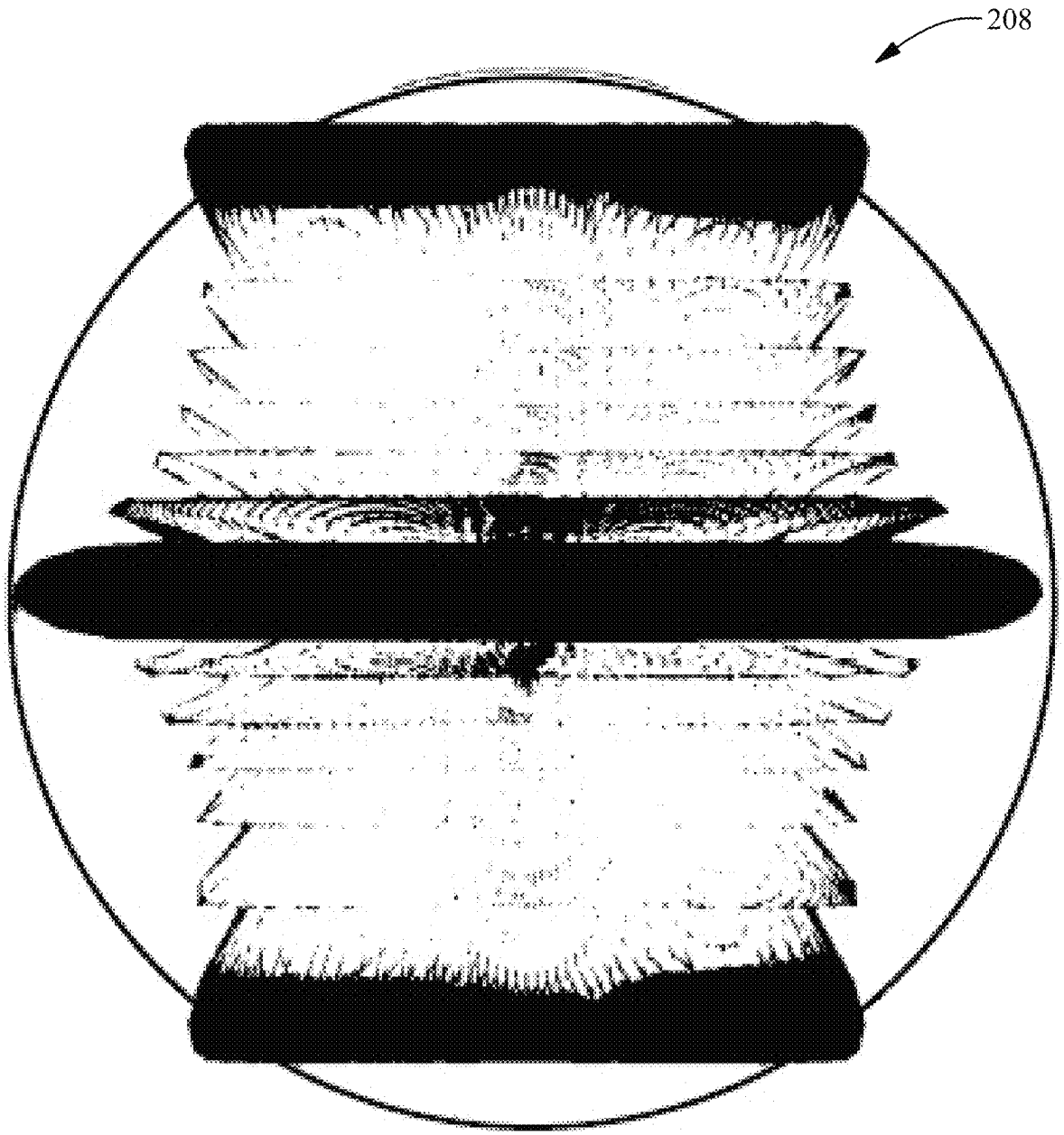
Figure 3:
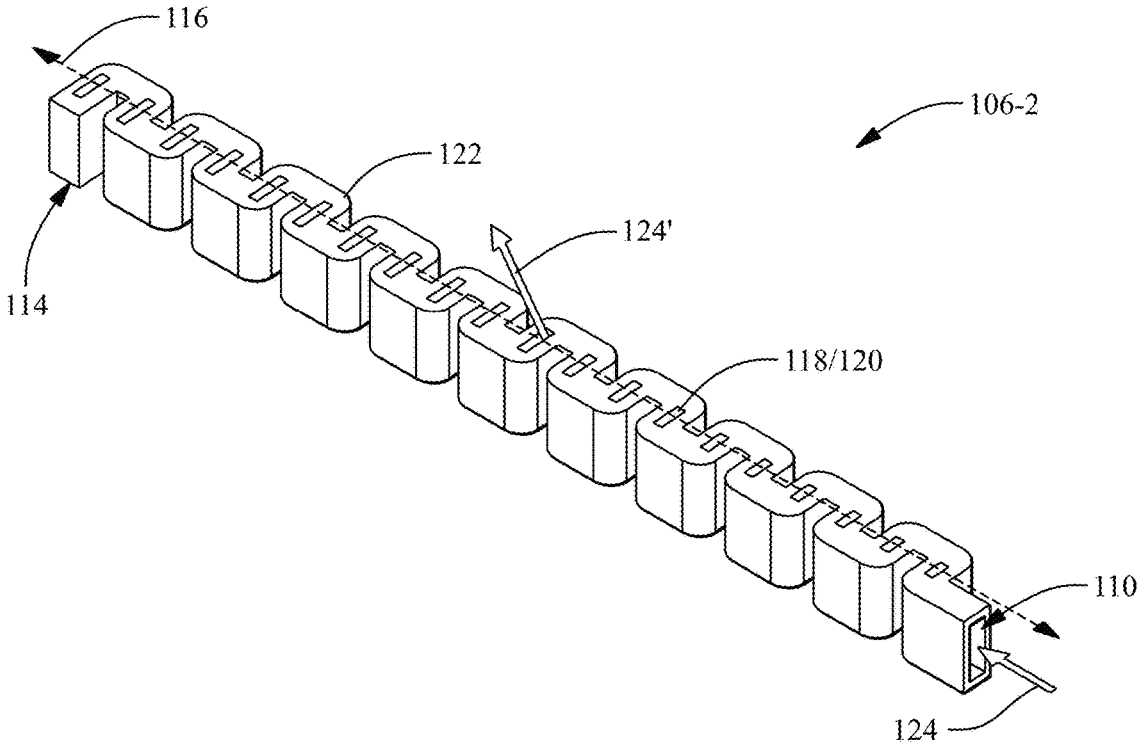
Figure 1:
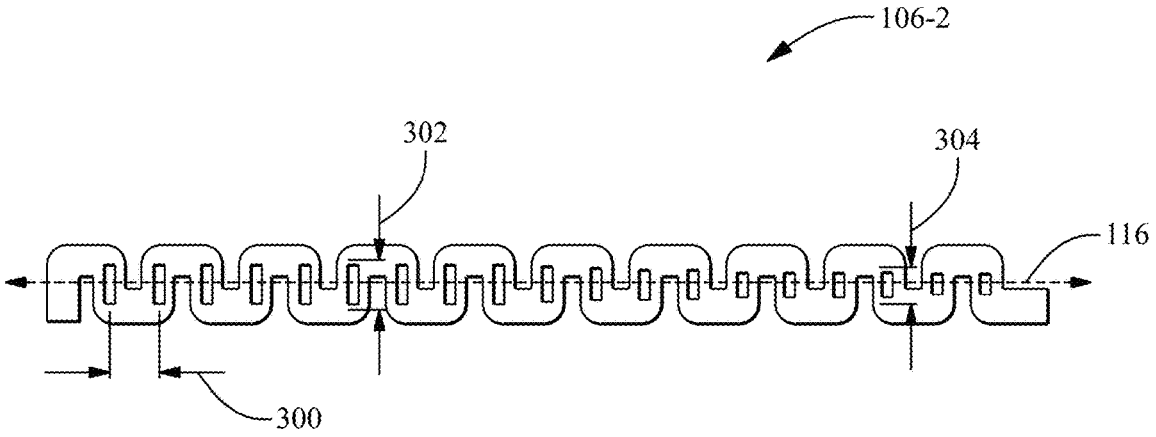
Figures 2, 3:
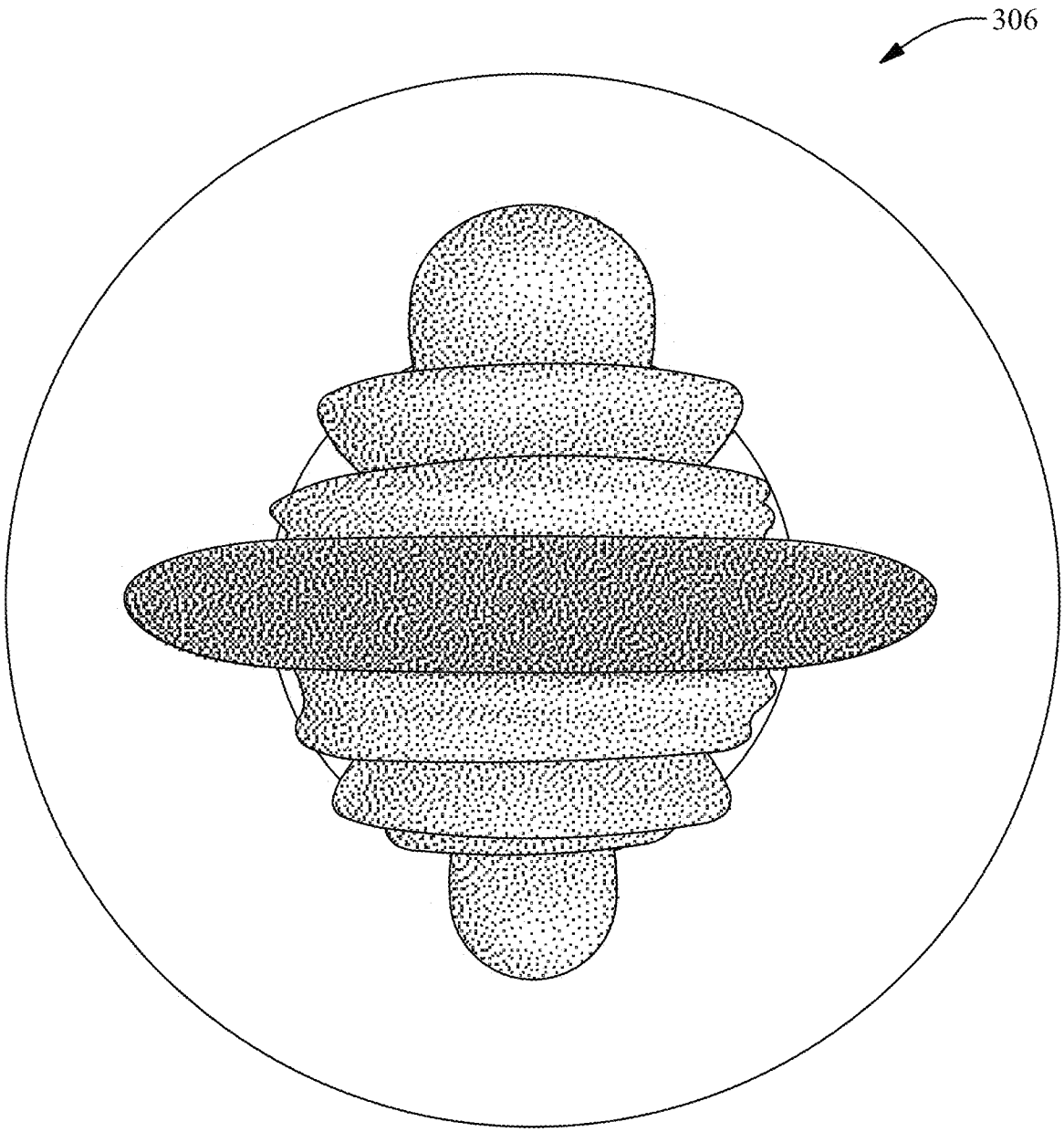
Figure 3:
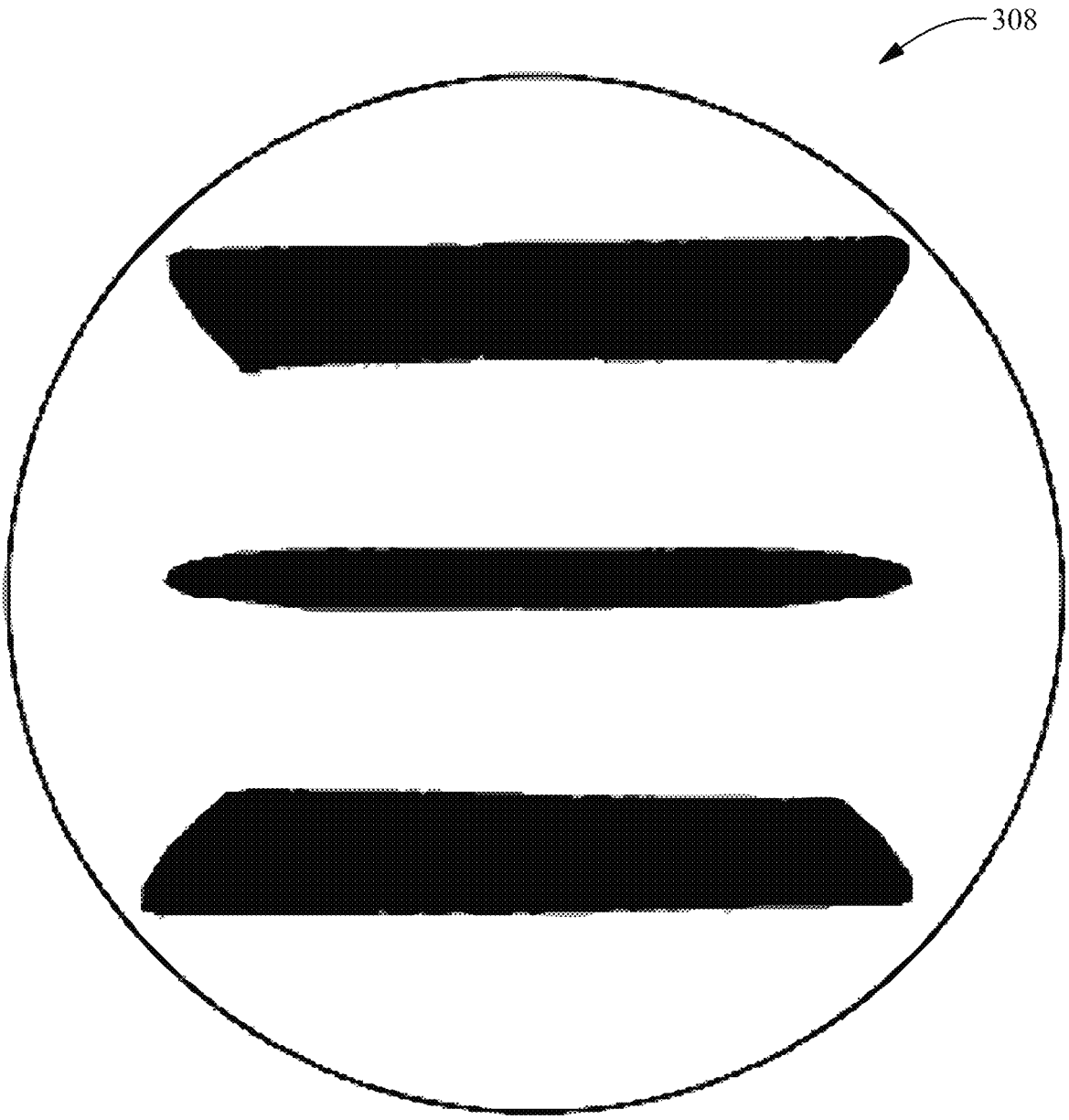

FIG. 2-3 illustrates an antenna pattern 208 without the example folded waveguide for antenna shown in FIG. 2-1. A drawback to such other waveguides includes the grating lobes shown in the antenna pattern 208 that appear on either side of the horizontal-polarity main beam.

FIG. 3-1 illustrates another example folded waveguide 106-2 for antenna, in accordance with techniques, apparatuses, and systems of this disclosure. The waveguide 106-2 is an example of the waveguide 106. Each radiation slot from the plurality of radiation slots 118 includes a lateral slot that is perpendicular to the longitudinal axis 116 to produce a vertical-polarized antenna pattern at the antenna element that is electrically coupled to the opposite end of the hollow core 108.

As shown in FIG. 3-1, the plurality of radiation slots 118 are evenly distributed between the rectangular opening 110 and the closed wall 114, and along the longitudinal axis 116 that runs in the longitudinal direction 112 through the hollow core 108. Each adjacent pair of radiation slots from the plurality of radiation slots 118 includes two radiation slots that are separated along the longitudinal axis 116 by a common distance 300 to produce the particular antenna pattern at the antenna 104 that is electrically coupled to the opposite end of the hollow core 108. The separation by the common distance 300 or pitch can prevent X-band lobes. The common distance 300 is much less than one wavelength of the electromagnetic radiation 124 that reaches the opposite end of the hollow core 108.

Each of the plurality of radiation slots 118 is sized and positioned on the surface 122 to produce a particular antenna pattern. The holes 120 of the plurality of radiation slots 118 have a larger size 302 near the wall 114 at the opposite end of the hollow core 108 and a smaller size 304 near the rectangular opening 110. The specific size and position of the radiation slots 118 can be determined by building and optimizing a model of the waveguide 106 to produce the particular antenna pattern desired.

FIG. 3-2 illustrates an antenna pattern associated with the example folded waveguide for the antenna shown in FIG. 3-1. Because each radiation slot is a lateral slot that is perpendicular to the longitudinal axis 116, the waveguide 106 is tuned to produce a vertical-polarized antenna pattern 306 at the antenna 104. As shown in FIG. 3-2, the X-band lobes can be avoided if the pitch of common distance 300 is less than the electromagnetic-radiation 124 wavelength. Elevation of the side lobe can be controlled by changing the size or length of the radiation slots 118.

FIG. 3-3 illustrates an antenna pattern 308 without the example folded waveguide for antenna shown in FIG. 3-1. A drawback to such other waveguides includes the X-band lobes shown in the antenna pattern 308 that appear on either side of the vertical-polarity main beam.

Figure 4:
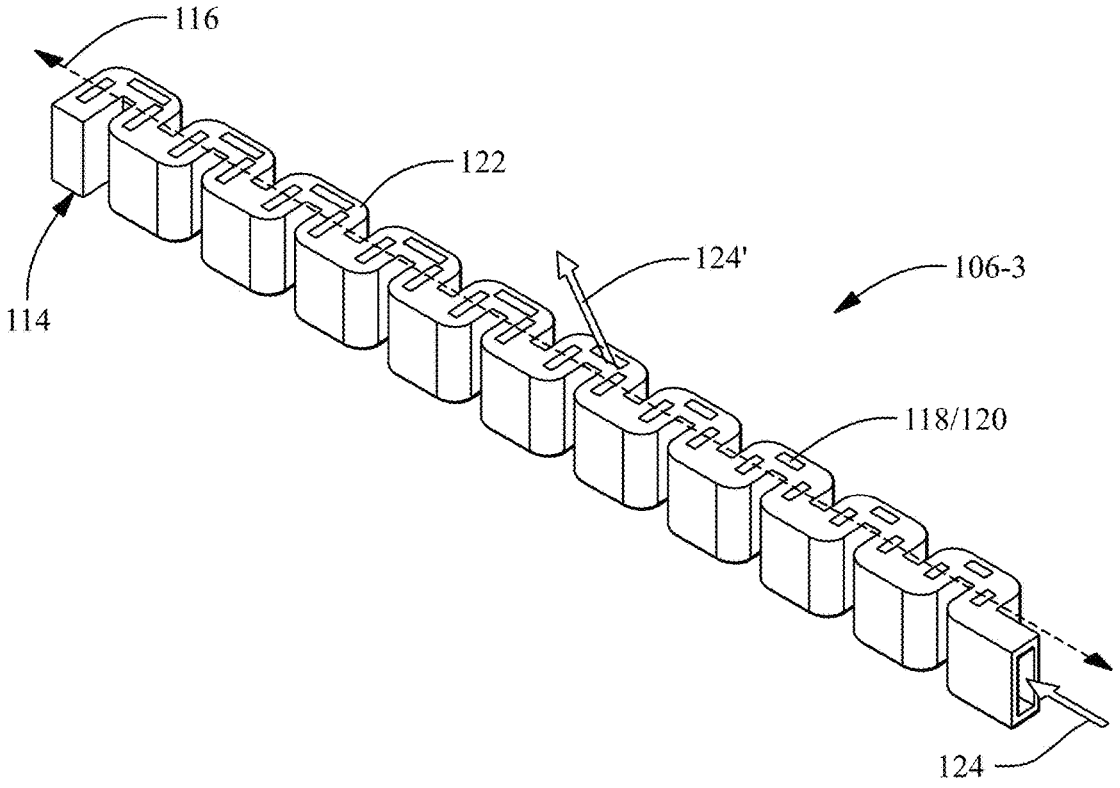
Figure 1:
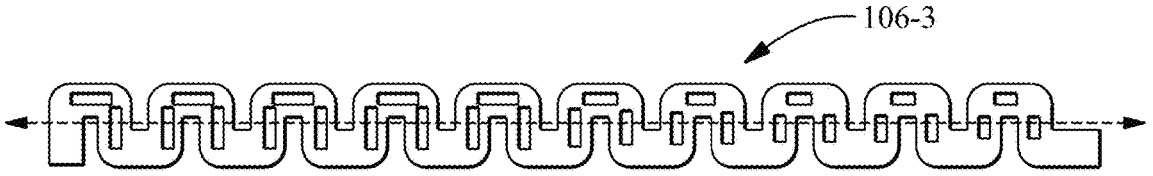
Figures 2, 4:
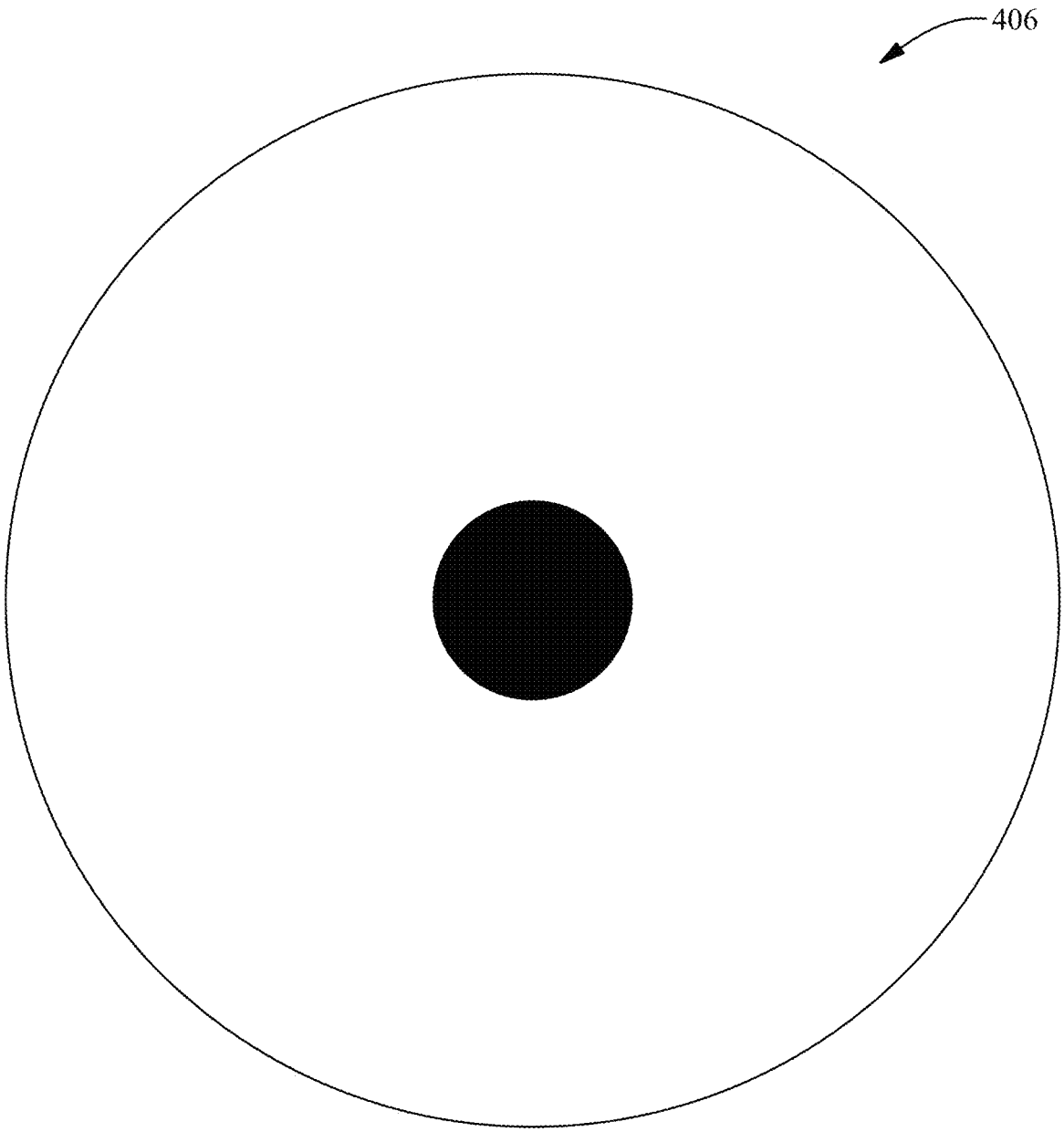

FIG. 4-1 illustrates another example folded waveguide 106-3 for antenna, in accordance with techniques, apparatuses, and systems of this disclosure. FIG. 4-1 represents a combination of the waveguide 106-1 and 106-2 and is therefore an example of the waveguide 106. As shown in FIG. 4-1, a first half of the plurality of radiation slots comprises a longitudinal slot that is parallel to the longitudinal axis, and a second half of the plurality of radiation slots comprises a lateral slot that is perpendicular to the longitudinal axis to produce a circular antenna pattern at the antenna element that is electrically coupled to the opposite end of the hollow core.

FIG. 4-2 illustrates an antenna pattern associated with the example folded waveguide for antenna shown in FIG. 4-1. Because a combination of lateral slots and longitudinal slots are used, the waveguide 106 is tuned to produce a circularly polarized antenna pattern 406 at the antenna 104. As shown in FIG. 4-2, the grating lobes and the X-band lobes can be avoided if the pitch of common distance between radiation slots is less than the electromagnetic-radiation 124 wavelength. Elevation of the side lobe can be controlled by changing the size or length of the radiation slots 118.

Figure 5:
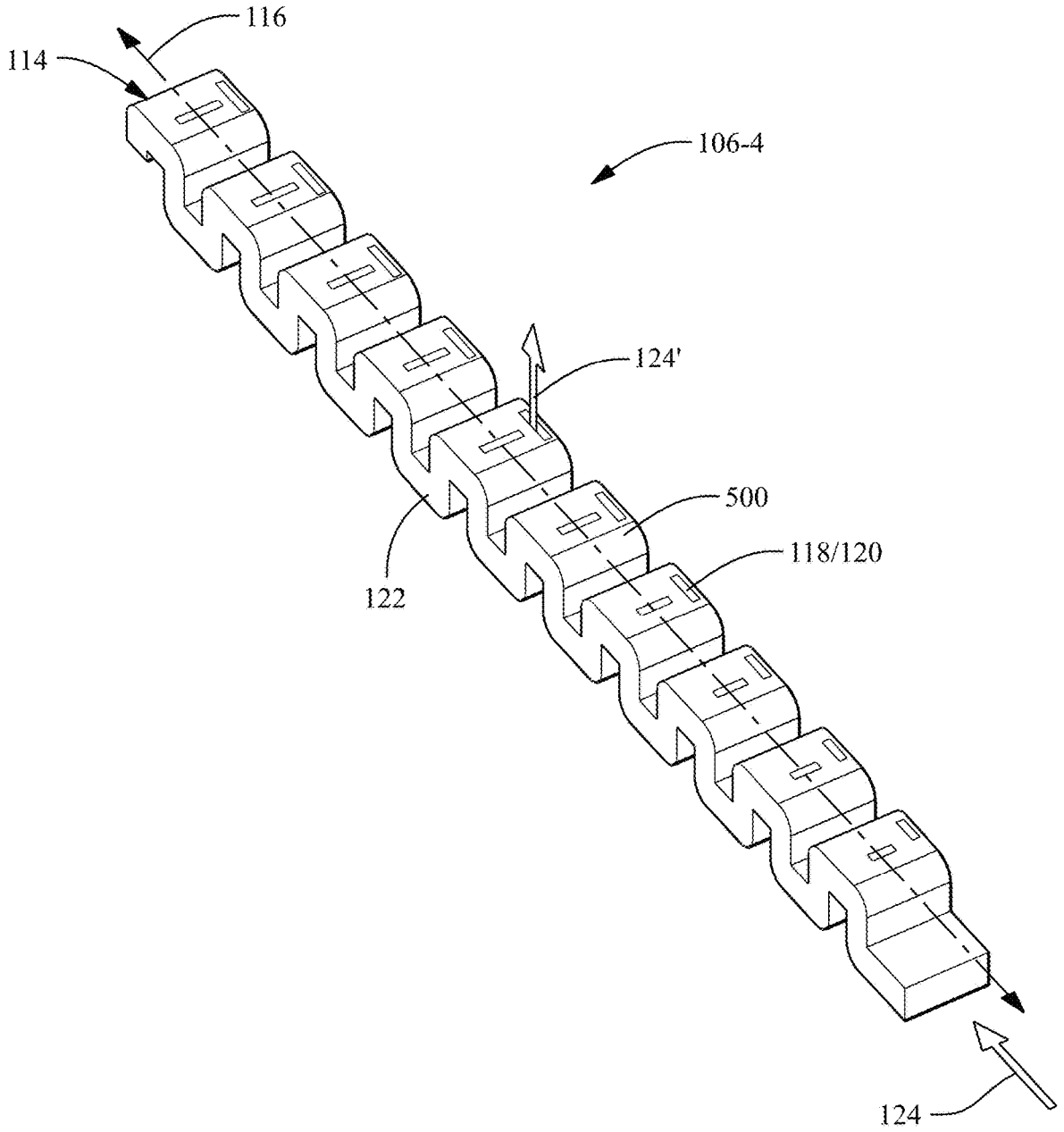
FIG. 5 illustrates another example folded waveguide for antenna, in accordance with techniques, apparatuses, and systems of this disclosure.

FIG. 5 illustrates another example folded waveguide 106-4 for antenna, in accordance with techniques, apparatuses, and systems of this disclosure. FIG. 5 is an example of the waveguide 106, having radiation slots in a different surface 500 than what is illustrated as the surface 122 in FIGS. 1, 2-1, 3-1, and 4-1. The surface 500 is perpendicular to the surface 122, which folds back and forth about the axis 114. As shown in FIG. 5, the plurality of radiation slots 120 comprises a combination of longitudinal slot that are parallel to the longitudinal axis, and lateral slots that are perpendicular to the longitudinal axis, although only longitudinal, or only lateral slots may be used depending on the particular antenna pattern desired. For instance, the combination shown in FIG. 5 produces a circular antenna pattern at the antenna element that is electrically coupled to the opposite end of the hollow core. If only longitudinal slots are used, a horizontal-polarity antenna pattern is produced. If only lateral slots are used, a vertical-polarity antenna pattern is produced.

Example Method

Figure 6:
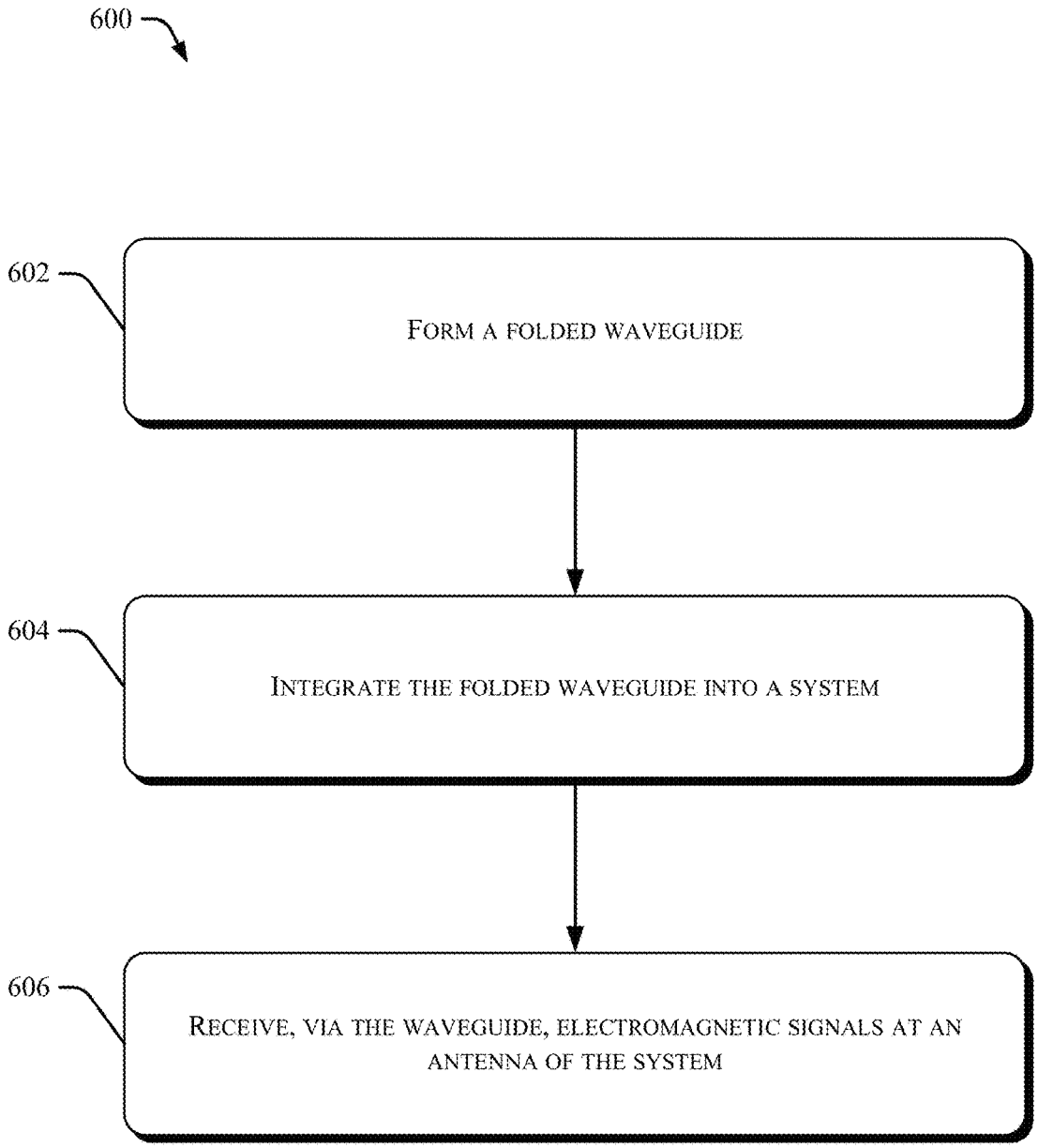
FIG. 6 depicts an example method that can be used for manufacturing a folded waveguide for antenna, in accordance with techniques, apparatuses, and systems of this disclosure.

FIG. 6 depicts an example method that can be used for manufacturing a folded waveguide for antenna, in accordance with techniques, apparatuses, and systems of this disclosure. The process 600 is shown as a set of operations 602 through 606, which are performed in, but not limited to, the order or combinations in which the operations are shown or described. Further, any of the operations 602 through 606 may be repeated, combined, or reorganized to provide other methods. In portions of the following discussion, reference may be made to the environment 100 and entities detailed in above, reference to which is made for example only. The techniques are not limited to performance by one entity or multiple entities.

At 602, a folded waveguide for antenna is formed. For example, the waveguide 106 can be stamped, etched, cut, machined, cast, molded, or formed in some other way. At 604, the folded waveguide is integrated into a system. For example, the waveguide 106 is electrically coupled to the antenna 104. At 606, electromagnetic signals are received via the waveguide at an antenna of the system. For example, the device 102 receives signals captured from air by the waveguide 106 and routed through the antenna 104.

Additional Examples

In the following section, additional examples of a folded waveguide for antenna are provided.

Example 1. An apparatus, the apparatus comprising: a folded waveguide comprising a hollow core, the hollow core forming: a rectangular opening in a longitudinal direction at one end; a closed wall at an opposite end; a sinusoidal shape that folds back and forth about a longitudinal axis that runs in the longitudinal direction through the hollow core; and a plurality of radiation slots, each of the radiation slots comprising a hole through one of multiple surfaces of the folded waveguide that defines the hollow core, the plurality of radiation slots being arranged on the one of the multiple surfaces to produce a particular antenna pattern for a device and an antenna element that is electrically coupled to the opposite end of the hollow core.

Example 2. The apparatus of any preceding example, wherein each of the plurality of radiation slots is configured to dissipate, from the hollow core, a portion of electromagnetic-radiation that enters the rectangular opening before that portion of the electromagnetic-radiation can reach the antenna element that is electrically coupled to the opposite end of the hollow core.

Example 3. The apparatus of any preceding example, wherein each of the plurality of radiation slots is sized and positioned on the one of the multiple surfaces to produce the particular antenna pattern at the antenna element that is electrically coupled to the opposite end of the hollow core.

Example 4. The apparatus of any preceding example, wherein the plurality of radiation slots is evenly distributed between the rectangular opening and the closed wall, and along the longitudinal axis that runs in the longitudinal direction through the hollow core.

Example 5. The apparatus of any preceding example, wherein each adjacent pair of radiation slots from the plurality of radiation slots comprises two radiation slots that are separated along the longitudinal axis by a common distance to produce the particular antenna pattern at the antenna element that is electrically coupled to the opposite end of the hollow core.

Example 6. The apparatus of any preceding example, wherein the common distance is less than one wavelength of electromagnetic radiation that reaches the hollow core.

Example 7. The apparatus of any preceding example, wherein each adjacent pair of radiation slots from the plurality of radiation slots comprises two radiation slots that are separated along the longitudinal axis by a common distance to prevent grating lobes or X-band lobes within the particular antenna pattern.

Example 8. The apparatus of any preceding example, wherein each radiation slot from the plurality of radiation slots comprises a lateral slot that is perpendicular to the longitudinal axis to produce a vertical-polarized antenna pattern at the antenna element that is electrically coupled to the opposite end of the hollow core.

Example 9. The apparatus of any preceding example, wherein each radiation slot from the plurality of radiation slots comprises a longitudinal slot that is parallel to the longitudinal axis to produce a horizontal-polarized antenna pattern at the antenna element that is electrically coupled to the opposite end of the hollow core.

Example 10. The apparatus of any preceding example, wherein a first half of the plurality of radiation slots comprises a longitudinal slot that is parallel to the longitudinal axis, and a second half of the plurality of radiation slots comprises a lateral slot that is perpendicular to the longitudinal axis to produce a circularly polarized antenna pattern at the antenna element that is electrically coupled to the opposite end of the hollow core.

Example 11. The apparatus of any preceding example, wherein the folded waveguide comprises metal.

Example 12. The apparatus of any preceding example, wherein the folded waveguide comprises plastic.

Example 13. A system, the system comprising: an antenna element; a device configured to transmit or receive electromagnetic signals via the antenna; and a folded waveguide comprising: a hollow core forming: a rectangular opening in a longitudinal direction at one end; a closed wall at an opposite end that is electrically coupled to the antenna element; a sinusoidal shape that folds back and forth about a longitudinal axis that runs in the longitudinal direction through the hollow core; and a plurality of radiation slots, each of the radiation slots comprising a hole through one of multiple surfaces of the folded waveguide that defines the hollow core, the plurality of radiation slots being arranged on the one of the multiple surfaces to produce a particular antenna pattern at the antenna element.

Example 14. The system of any preceding example, wherein the device comprises a radar device.

Example 15. The system of any preceding example, further comprising a vehicle comprising the antenna element, the device, and the folded waveguide.

Example 16. The system of any preceding example, wherein each of the plurality of radiation slots is configured to dissipate, from the hollow core, a portion of electromagnetic-radiation that enters the rectangular opening before that portion of the electromagnetic-radiation can reach the antenna element that is electrically coupled to the opposite end of the hollow core.

Example 17. The system of any preceding example, wherein each of the plurality of radiation slots is sized and positioned on the one of the multiple surfaces to produce the particular antenna pattern at the antenna element that is electrically coupled to the opposite end of the hollow core.

Example 18. The system of any preceding example, wherein each radiation slot from the plurality of radiation slots comprises a lateral slot that is perpendicular to the longitudinal axis to produce a horizontal-polarized antenna pattern at the antenna element that is electrically coupled to the opposite end of the hollow core; wherein each radiation slot from the plurality of radiation slots comprises a longitudinal slot that is parallel to the longitudinal axis to produce a vertical-polarized antenna pattern at the antenna element that is electrically coupled to the opposite end of the hollow core; or wherein a first portion of the plurality of radiation slots comprises a longitudinal slot that is parallel to the longitudinal axis, and a second portion of the plurality of radiation slots comprises a lateral slot that is perpendicular to the longitudinal axis to produce a circularly polarized antenna pattern at the antenna element that is electrically coupled to the opposite end of the hollow core.

Example 19. The system of any preceding example, wherein each of the plurality of radiation slots comprises a hole through a particular surface of the multiple surfaces, the particular surface being one of two surfaces that folds back and forth about the longitudinal axis that runs in the longitudinal direction through the hollow core.

Example 20. The system of any preceding example, wherein each of the plurality of radiation slots comprises a hole through a particular surface of the multiple surfaces, the particular surface being one of two surfaces that is perpendicular to two other surfaces that fold back and forth about the longitudinal axis that runs in the longitudinal direction through the hollow core.

CONCLUSION

While various embodiments of the disclosure are described in the foregoing description and shown in the drawings, it is to be understood that this disclosure is not limited thereto but may be variously embodied to practice within the scope of the following claims. From the foregoing description, it will be apparent that various changes may be made without departing from the spirit and scope of the disclosure as defined by the following claims.

The use of "or" and grammatically related terms indicates non-exclusive alternatives without limitation unless the context clearly dictates otherwise. As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

What is claimed is:

1. An apparatus, the apparatus comprising:

a folded waveguide comprising a hollow core, the hollow core forming:

a rectangular opening in a longitudinal direction at one end;

a closed wall at an opposite end;

a sinusoidal shape that folds back and forth about a longitudinal axis that runs in the longitudinal direction through the hollow core; and a plurality of radiation slots, each of the radiation slots comprising a hole through one of multiple surfaces of the folded waveguide that defines the hollow core, the plurality of radiation slots being arranged on the one of the multiple surfaces to produce a particular antenna pattern for a device and an antenna element that is directly coupled to the opposite end of the hollow core.

2. The apparatus of claim 1, wherein each of the plurality of radiation slots is configured to dissipate, from the hollow core, a portion of electromagnetic radiation that enters the rectangular opening before that portion of the electromagnetic radiation can reach the antenna element that is electrically coupled to the opposite end of the hollow core.

3. The apparatus of claim 1, wherein each of the plurality of radiation slots is sized and positioned on the one of the multiple surfaces to produce the particular antenna pattern at the antenna element that is electrically coupled to the opposite end of the hollow core.

4. The apparatus of claim 3, wherein the plurality of radiation slots is evenly distributed between the rectangular opening and the closed wall, and along the longitudinal axis that runs in the longitudinal direction through the hollow core.

5. The apparatus of claim 4, wherein each adjacent pair of radiation slots from the plurality of radiation slots comprises two radiation slots that are separated along the longitudinal axis by a common distance to produce the particular antenna pattern at the antenna element that is electrically coupled to the opposite end of the hollow core.

6. The apparatus of claim 5, wherein the common distance is less than one wavelength of electromagnetic radiation that reaches the opposite end of the hollow core.

7. The apparatus of claim 4, wherein each adjacent pair of radiation slots from the plurality of radiation slots comprises two radiation slots that are separated along the longitudinal axis by a common distance to prevent grating lobes or X-band lobes within the particular antenna pattern.

8. The apparatus of claim 1, wherein each radiation slot from the plurality of radiation slots comprises a lateral slot that is perpendicular to the longitudinal axis to produce a horizontal-polarized antenna pattern at the antenna element that is electrically coupled to the opposite end of the hollow core.

9. The apparatus of claim 1, wherein each radiation slot from the plurality of radiation slots comprises a longitudinal slot that is parallel to the longitudinal axis to produce a vertical-polarized antenna pattern at the antenna element that is electrically coupled to the opposite end of the hollow core.

10. The apparatus of claim 1, wherein a first half of the plurality of radiation slots comprises a longitudinal slot that is parallel to the longitudinal axis, and a second half of the plurality of radiation slots comprises a lateral slot that is perpendicular to the longitudinal axis to produce a circularly polarized antenna pattern at the antenna element that is electrically coupled to the opposite end of the hollow core.

11. The apparatus of claim 1, wherein the folded waveguide comprises metal.

12. The apparatus of claim 1, wherein the folded waveguide comprises plastic.

13. A system, the system comprising:

an antenna element;

a device configured to transmit or receive electromagnetic signals via the antenna; and a folded waveguide comprising:

a hollow core forming:

a rectangular opening in a longitudinal direction at one end;

a closed wall at an opposite end that is directly coupled to the antenna element;

a sinusoidal shape that folds back and forth about a longitudinal axis that runs in the longitudinal direction through the hollow core; and a plurality of radiation slots, each of the radiation slots comprising a hole through one of multiple surfaces of the folded waveguide that defines the hollow core, the plurality of radiation slots being arranged on the one of the multiple surfaces to produce a particular antenna pattern at the antenna element.

14. The system of claim 13, wherein the device comprises a radar device.

15. The system of claim 13, further comprising a vehicle comprising the antenna element, the device, and the folded waveguide.

16. The system of claim 13, wherein each of the plurality of radiation slots is configured to dissipate, from the hollow core, a portion of electromagnetic-radiation that enters the rectangular opening before that portion of the electromagnetic-radiation can reach the antenna element that is electrically coupled to the opposite end of the hollow core.

17. The system of claim 13, wherein each of the plurality of radiation slots is sized and positioned on the one of the multiple surfaces to produce the particular antenna pattern at the antenna element that is electrically coupled to the opposite end of the hollow core.

18. The system of claim 13, wherein each radiation slot from the plurality of radiation slots comprises a lateral slot that is perpendicular to the longitudinal axis to produce a horizontal-polarized antenna pattern at the antenna element that is electrically coupled to the opposite end of the hollow core;

wherein each radiation slot from the plurality of radiation slots comprises a longitudinal slot that is parallel to the longitudinal axis to produce a vertical-polarized antenna pattern at the antenna element that is electrically coupled to the opposite end of the hollow core; or wherein a first portion of the plurality of radiation slots comprises a longitudinal slot that is parallel to the longitudinal axis, and a second portion of the plurality of radiation slots comprises a lateral slot that is perpendicular to the longitudinal axis to produce a circularly polarized antenna pattern at the antenna element that is electrically coupled to the opposite end of the hollow core.

19. The system of claim 13, wherein each of the plurality of radiation slots comprises a hole through a particular surface of the multiple surfaces, the particular surface being one of two surfaces that folds back and forth about the longitudinal axis that runs in the longitudinal direction through the hollow core.

20. The system of claim 13, wherein each of the plurality of radiation slots comprises a hole through a particular surface of the multiple surfaces, the particular surface being one of two surfaces that is perpendicular to two other surfaces that fold back and forth about the longitudinal axis that runs in the longitudinal direction through the hollow core.

* * * * *